US006241695B1

(12) United States Patent
Dabir

(10) Patent No.: US 6,241,695 B1
(45) Date of Patent: Jun. 5, 2001

(54) APPARATUS AND METHOD FOR PRESSURE MANAGEMENT

(76) Inventor: Reza R. Dabir, 217 Stephens Rd., Grosse Pointe Farms, MI (US) 48236

( * ) Notice: Subject to any disclaimer, the term of this patent is extended or adjusted under 35 U.S.C. 154(b) by 0 days.

(21) Appl. No.: 09/371,685

(22) Filed: Aug. 10, 1999

(51) Int. Cl.[7] ..... A61H 19/00

(52) U.S. Cl. ..... 601/136; 601/28; 601/134; 601/146

(58) Field of Search ..... 601/134, 136, 601/28, 131, 132–133, 135, 137–138, 14, 146; 428/159–160, 182–183

(56) References Cited

U.S. PATENT DOCUMENTS

| | | | |
|---|---|---|---|
| 1,982,516 | | 11/1934 | Holmested . |
| 3,107,665 | * | 10/1963 | Nordgren . |
| 4,037,591 | * | 7/1977 | Sarno . |
| 4,509,510 | | 4/1985 | Hook . |
| 4,967,433 | | 11/1990 | Neal . |
| 5,153,956 | | 10/1992 | Nold . |
| 5,327,598 | | 7/1994 | Liou . |
| 5,820,573 | | 10/1998 | Ramos . |

* cited by examiner

*Primary Examiner*—Michael A. Brown
*Assistant Examiner*—Lalita M Hamilton
(74) *Attorney, Agent, or Firm*—Brooks & Kushman P.C.

(57) ABSTRACT

An apparatus and method for alleviating excessive pressure development on a body area are provided. The apparatus is preferably embodied in a cushion, and includes a bottom surface and a top surface which is spaced from the bottom surface and has a plurality of channels formed therethrough. A compressible inner layer is disposed between the top and bottom surfaces, and a plurality of elongate, inflexible members are supported by the inner layer and are disposed at least partially within the channels. The members have first ends that extend at least partially through the channels to project beyond the top surface, where the members are located at a neutral position in the absence of pressure. In operation, pressure applied to the first ends causes the members to be displaced axially along the channels away from the neutral position and toward the bottom surface without deformation. Therefore, applied pressure produced by contact with a body area creates a plurality of point pressures on the body area, and the undeformed displacement of the members acts to maintain the plurality of point pressures on the contacted body area and prevent widespread, excessive pressure from developing.

21 Claims, 2 Drawing Sheets

APPARATUS AND METHOD FOR PRESSURE MANAGEMENT

TECHNICAL FIELD

This invention relates to an apparatus and method for alleviating or preventing excessive pressure, and therefore pressure sores, from developing on a contacted body area.

BACKGROUND ART

A pressure sore is any lesion caused by excessive, unrelieved pressure on an area of the body. When pressures above normal homeostatic pressure are applied to a body region and its associated blood vessels, the blood vessels can partially or fully collapse, thereby disrupting normal circulation. As a result, the affected area becomes devoid of blood supply, which prohibits oxygen and nutrients from being delivered to the surrounding tissue. Pressure sores often occur over bony prominences, and can range in severity from partial thickness skin loss to full thickness skin loss with tissue necrosis and damage to underlying muscle and bone.

Pressure sores are a common and costly problem in bed and chair-bound individuals, as well as in patients having an impaired ability to reposition themselves, such as those on ventilators or under anesthesia. In such individuals, various areas of the body may be permanently or almost permanently in contact with the support surface of the bed or chair, resulting in excessive pressure, lack of air circulation, and often increased shear between the contacted body area and the support surface.

Various systems have been proposed to reduce or prevent pressure sores. Among the most common prevention systems are mattresses, cushions, or pads that include some type of raised members extending from a flat base as shown, for example, in U.S. Pat. No. 5,153,956 issued to Nold. The raised members are spaced apart and designed to contact the body at numerous points in an attempt to lower the pressure between the affected body area and the support surface and equalize the pressure over the entire surface of the body. In order to be effective in this capacity, the raised members are designed to be of a height sufficient to maintain the body away from the base. However, upon the application of pressure by contact with the body, the raised members tend to bend and collapse into contact with the base, such that the body is resting against a substantially flat surface with broad points of contact. This action negates any lowering of pressure of the affected area, while also decreasing aeration and increasing the potential for shear between the body member and the pad.

DISCLOSURE OF INVENTION

Therefore, it is an object according to the present invention to provide an apparatus and method for pressure management, including alleviating or preventing excessive pressure development on a contacted body area.

It is a further object according to the present invention to provide an apparatus and method for alleviating or preventing excessive pressure development on a body area that function reliably regardless of the pressure applied by the contacted body area.

It is a still further object according to the present invention to provide an apparatus and method for alleviating or preventing excessive pressure development on a body area wherein the apparatus is embodied in a cushion or the like.

Accordingly, an apparatus for alleviating, and preferably preventing, excessive pressure development on a body area is provided. The apparatus includes a bottom surface and a top surface which is spaced from the bottom surface, and where the top surface has a plurality of channels formed therethrough. A compressible inner layer is disposed between the top and bottom surfaces, and a plurality of elongate, inflexible members are supported by the inner layer and disposed at least partially within the channels. The members have first ends that extend at least partially through the channels to project beyond the top surface, and in the absence of pressure the members are located at a neutral position. In operation, pressure applied to the first ends by contact with the body area causes the members to be displaced axially along the channels away from the neutral position and toward the bottom surface without deformation.

In a preferred embodiment, the members are longer than the distance between the top and bottom surfaces, such that the members extend beyond the top surface independent of the applied pressure in order to maintain a plurality of point pressures on a body area. In addition, the members include second ends located beneath the top surface, where each second end preferably includes an enlarged base operable to limit the distance that each member projects beyond the top surface. These second ends can be attached to the inner layer, which is preferably operable to return the members to the neutral position upon removal of the applied pressure.

In further accordance with a preferred embodiment of the present invention, the members have rounded first ends for added comfort when in contact with the body area. At least a subset of the channels are preferably densely spaced in order to provide a plurality of point pressures to the contacted body area. In terms of materials, the top and bottom surfaces are preferably constructed from a material, such as plastic, that is rigid relative to the inner layer. Additionally, the inner layer is preferably constructed of a foam material and the members can be constructed from either a rigid plastic or metallic material. In a preferred embodiment, the apparatus includes fasteners affixed thereto that are operable to removably attach the apparatus to another object, such as a standard chair, wheelchair, mattress, or to a part of the human body such as the heel or elbow.

Correspondingly, a method for alleviating or preventing excessive pressure development on a body area is provided. The method includes providing an apparatus which has a bottom surface, a top surface which is spaced from the bottom surface and has a plurality of channels formed therethrough, and a compressible inner layer which is disposed between the top and bottom surfaces. The method also includes providing a plurality of elongate, inflexible members which are supported by the inner layer and disposed at least partially within the channels, the members having first ends that extend at least partially through the channels to project beyond the top surface, such that in the absence of pressure the members are located at a neutral position. The method further includes applying pressure to one or more of the first ends by contact with the body area, thereby creating a plurality of point pressures on the body area. Still further, the method includes displacing the members axially along the channels away from the neutral position and toward the bottom surface without deformation so as to maintain the plurality of point pressures and prevent excessive pressure from developing on the body area.

In a preferred embodiment, the method further includes returning the members substantially to the neutral position by removing contact of the body area with the one or more first ends. Furthermore, displacing the members axially is preferably limited by compression of the inner layer and the bottom surface. Still further, the method preferably includes removably attaching the apparatus to another object, such as a chair, wheelchair, or mattress, or to a part of the body such as the heel or elbow.

The above objects and other objects, features, and advantages of the present invention are readily apparent from the following detailed description of the best mode for carrying out the invention when taken in connection with the accompanying drawings wherein like reference numerals correspond to like components.

BEST MODE FOR CARRYING OUT THE INVENTION

The present invention is directed to an apparatus and method for alleviating or preventing excessive pressure development on a contacted body area. As described in greater detail below, the apparatus according to the present invention functions to maintain a plurality of focused, point pressures on a body area, independent of the pressure applied by the body area to the apparatus. The ability of the apparatus of the present invention to maintain these numerous point pressures aids in preventing or alleviating the development of widespread, excessive pressure on the contacted body area, thereby reducing the likelihood that pressure sores (also known in the art as bed sores) will develop.

Figure 1:
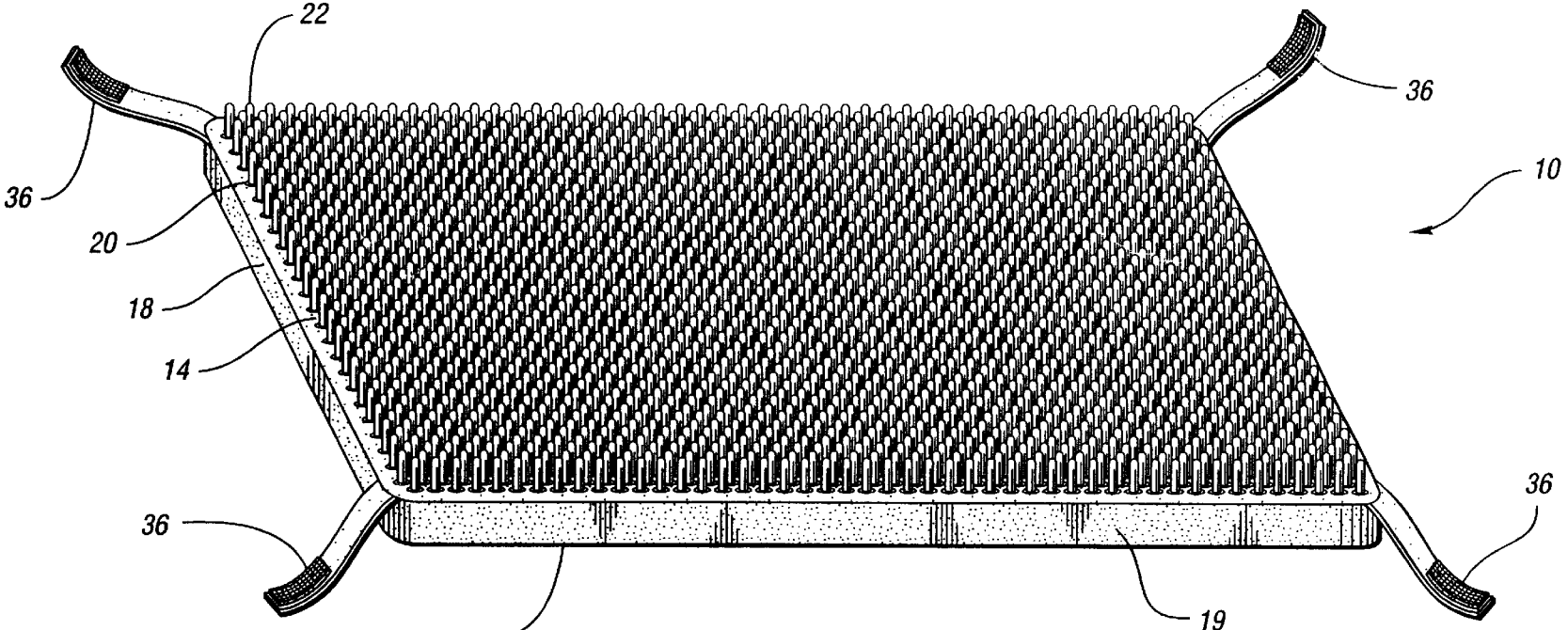
FIG. 1 is a perspective view of the apparatus of the present invention shown as a cushion of the preferred embodiment.
Figure 2:
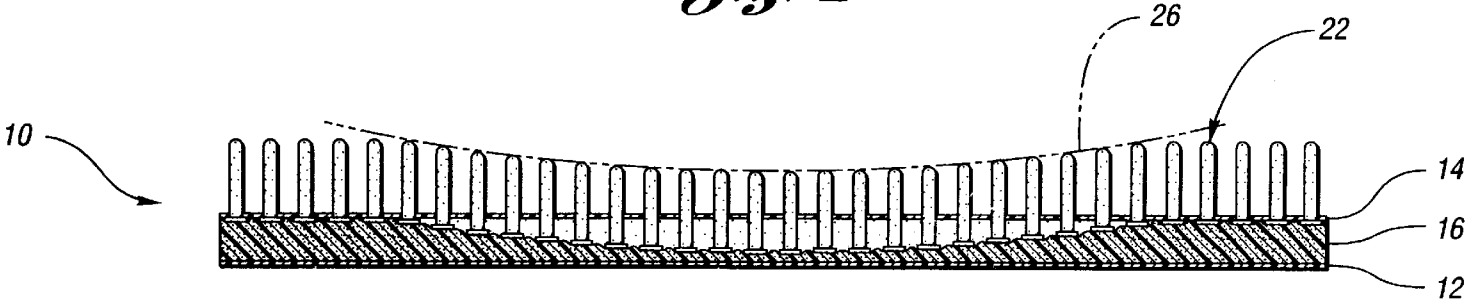
FIG. 2 is a side, cross-sectional view of the cushion of FIG. 1 upon contact with a body area.
Figure 3:
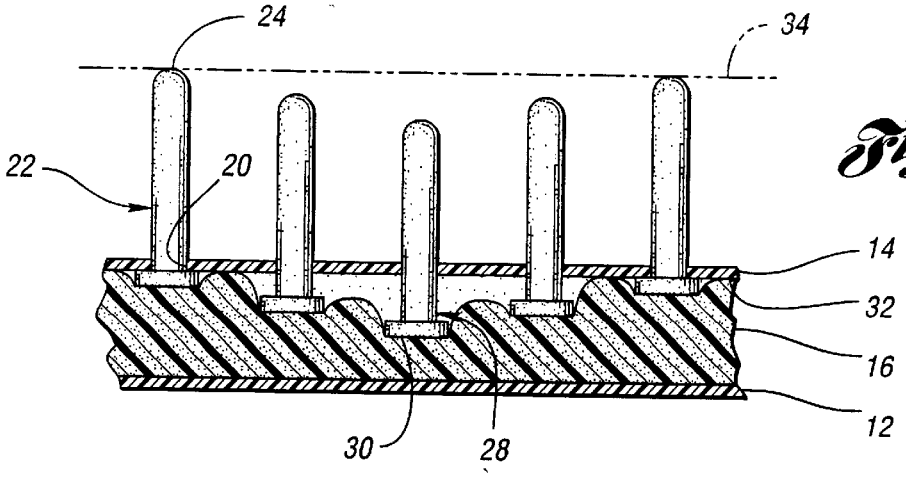
FIG. 3 is an enlarged, cut-away view of the cushion of FIG. 2.

Referring first to FIG. 1, the apparatus of the present invention is illustrated in a preferred cushion embodiment and is indicated generally by reference numeral 10. Cushion 10 comprises a generally planar bottom surface 12 and a generally planar top surface 14 which is spaced from and overlying the bottom surface 12. In this embodiment, top 14 and bottom 12 surfaces are preferably oriented substantially parallel to one another. Top 14 and bottom 12 surfaces are also preferably constructed from a rigid material, most preferably a plastic material such as polypropylene, ABS, or the like. A compressible inner layer 16, best shown in FIGS. 2 and 3, is disposed between top 14 and bottom 12 surfaces. Although inner layer 16 can be composed of any compressible material, in a preferred embodiment inner layer 16 comprises a foam material. The foam material preferably has a durometer between approximately 1 and 5 lb/in. Inner layer 16 is preferably enclosed between top 14 and bottom 12 surfaces as well as two sets of opposing side surfaces 18, 19.

As shown in FIGS. 1–3, top surface 14 has a plurality of channels 20 formed therethrough. At least a subset of channels 20 are preferably densely spaced, and most preferably at a distance of approximately ⅛ to ¼ apart. Of course, channels 20 may be spaced at any desirable interval, in accordance with the teachings of the present invention. A plurality of elongate, inflexible members 22 are supported by inner layer 16, where each member 22 is disposed at least partially within one of the channels 20. Members 22 can be constructed from a rigid plastic material, such as nylon or ABS, or a rigid metallic material such as aluminum. The channels 20 and members 22 shown in FIGS. 1–3 are cylindrical in shape, but can be embodied in any other shape suitable to impart a point pressure to a contacted body area. Depending on the intended use of cushion 10, the spacing of channels 20, and the corresponding members 22, can be varied in any manner over top surface 14.

Referring now to FIGS. 2 and 3, members 22 have first ends 24 that extend through channels 20 to project beyond top surface 14 of cushion 10. It is these first ends 24 that, in operation, are in contact with a body area 26. In a preferred embodiment, first ends 24 are rounded for added comfort, however first ends 24 may take any shape feasible for the intended application. It is fully contemplated that body area 26 may be any portion of the body which is susceptible to the development of excessive pressure and pressure sores including, but not limited to, the arms, legs, back, and buttocks.

As shown in FIG. 3, members 22 have second ends 28 located beneath top surface 14 of cushion 10, wherein second ends 28 can be attached to inner layer 16 for added stability of members 22 within channels 20. Each second end 28 preferably includes an enlarged base 30 which is operable to abut the underside 32 of top surface 14, thereby limiting the distance that each member 22 projects beyond top surface 14. In the absence of applied pressure, the distance at which each member 22 projects beyond top surface 14 is defined as its neutral position, which is indicated generally by reference numeral 34 in FIG. 3.

Referring again to FIGS. 2 and 3, pressure is applied to one or more of first ends 24 by contact with body area 26, thereby creating a plurality of focused point pressures on body area 26. This applied pressure displaces members 22 axially along channels 20 away from the neutral position 34 and toward bottom surface 12. Due to the inflexibility of members 22, this displacement of members 22 occurs without their vertical or lateral deformation, such that the plurality of point pressures on body area 26 is maintained. As a result, widespread contact, and therefore pressure, between body area 26 and cushion 10 is alleviated or avoided.

In a preferred embodiment, the distance between top 14 and bottom 12 surfaces is designed to be less than the length of members 22, such that members 22 cannot become totally displaced from channels 20 and into inner layer 16 when pressure is applied by body area 26. In particular, bases 30 of members 22 compress inner layer 16 until bottom surface 12 of cushion 10 limits the movement of members 22. With such a configuration, members 22 always extend beyond top surface 14 to some degree, regardless of the applied pressure. Inner layer 16 is then operable to return projections 22 substantially to the neutral position 34 upon removal of the applied pressure. It is fully contemplated that, depending on the intended application, members 22 may be of different sizes, widths, and lengths, and may therefore have varying neutral positions.

Therefore, the cushion 10 of the present invention functions to create multiple focused pressure points on the body area 26 contacted by members 22. In this way, weight is dispersed more evenly and many regions are formed between members 22 where a normal circulatory state exists. Due to these regions of normal circulation, the overall vascular and lymphatic supply of the body area 26 are kept intact and oxygen and nutrients are able to be delivered to the focused pressure points resulting from members 22. The existence of normal circulatory activity is a strong deterrent to the development of pressure sores.

Figure 4:
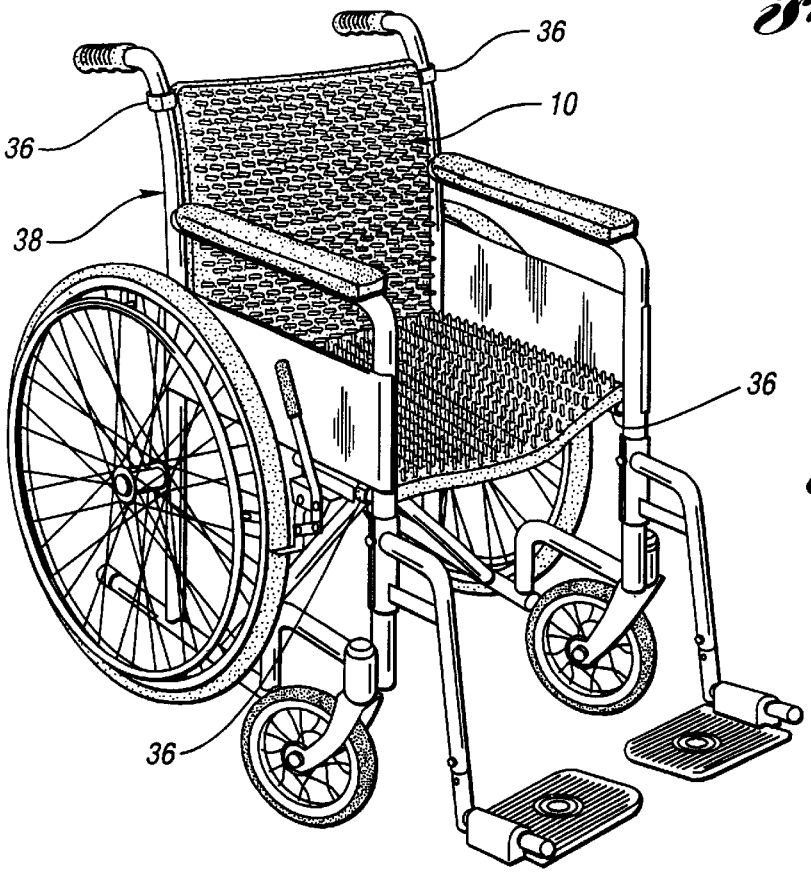
FIG. 4 shows the apparatus of the present invention removably attached to a standard wheelchair.

Cushion 10 according to the present invention is preferably portable as well as disposable. Cushion 10 can be embodied in any type of mattress or pad, and can be of any dimension suitable for its intended use. In addition to medical care applications, such as a mattress for hospital beds or a cushion for a wheelchair seat, cushion 10 can be used in a variety of other applications. For example, cushion 10 could be utilized as a covering for vehicle seats, or as a chair or mattress cover in domestic or office settings. As shown in FIG. 4, cushion 10 preferably includes fasteners 36, such as Velcro™ straps, affixed to top 14 or bottom 12 surface that are operable to removably attach cushion 10 to another object, for example, a standard wheelchair 38.

Figure 5:
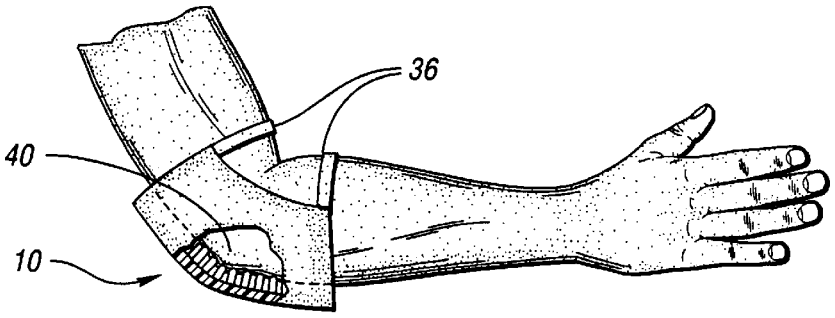
FIG. 5 shows a partial cut-away view of the apparatus according to the present invention removably attached to a body area, illustrated in the drawing as a elbow.

In addition, cushion 10 can be attached to a part of the human body for use as a guard. For example, FIG. 5 shows cushion 10 attached to a body part 40, shown for example as an elbow, and thus allows cushion 10 to serve as an elbow guard. Of course, it is fully contemplated that other parts of the body, including but not limited to the heel, knee, and head, would be equally suitable for this application according to the teachings of the present invention.

While embodiments of the invention have been illustrated and described, it is not intended that these embodiments illustrate and describe all possible forms of the invention. Rather, the words used are words of description rather than limitation, and it is understood that various changes may be made without departing from the spirit and scope of the invention.

What is claimed is:

1. An apparatus for alleviating the excessive pressure development on a body area, the apparatus comprising:

a bottom surface;

a top surface spaced from the bottom surface, the top surface having a plurality of channels formed therethrough;

a compressible inner layer disposed between the top and bottom surfaces; and a plurality of elongate, inflexible members supported by the inner layer and disposed at least partially within the channels, the members having first ends that extend at least partially through the channels to project beyond the top surface, wherein in the absence of pressure the members are located at a neutral position, and wherein pressure applied to the first ends by contact with the body area causes the members to be displaced axially along the channels away from the neutral position and toward the bottom surface without deformation.

2. The apparatus of claim 1, wherein the members are longer than the distance between the top and bottom surfaces, such that the members extend beyond the top surface independent of the applied pressure.

3. The apparatus of claim 1, wherein the members further include second ends located beneath the top surface.

4. The apparatus of claim 3, wherein each second end includes an enlarged base operable to limit the distance that each member projects beyond the top surface.

5. The apparatus of claim 3, wherein the second ends are attached to the inner layer.

6. The apparatus of claim 1, wherein the inner layer is operable to return the projections substantially to the neutral position upon removal of the applied pressure.

7. The apparatus of claim 1, wherein the members have rounded first ends.

8. The apparatus of claim 1, wherein at least a subset of the channels are spaced approximately ⅛ to ¼ apart.

9. The apparatus of claim 1, wherein the inner layer is enclosed between the top and bottom surfaces and two sets of opposing side surfaces.

10. The apparatus of claim 1, wherein the top and bottom surfaces are rigid relative to the inner layer.

11. The apparatus of claim 1, wherein the top and bottom surfaces are formed of a plastic material.

12. The apparatus of claim 1, wherein the inner layer is formed of a foam material.

13. The apparatus of claim 12, wherein the foam has a durometer in the range between approximately 1 and 5 lb/in.

14. The apparatus of claim 1, wherein the members are formed of a plastic material.

15. The apparatus of claim 1, wherein the members are formed of a metallic material.

16. The apparatus of claim 1, further comprising fasteners affixed to the apparatus that are operable to removably attach the apparatus to another object or to a part of the body.

17. A method for alleviating excessive pressure development on a body area, the method comprising:

providing an apparatus having a bottom surface, a top surface spaced from the bottom surface and having a plurality of channels formed therethrough, a compressible inner layer disposed between the top and bottom surfaces, and a plurality of elongate, inflexible members supported by the inner layer and disposed at least partially within the channels, the members having first ends that extend at least partially through the channels to project beyond the top surface, wherein the members are located at a neutral position in the absence of pressure;

applying pressure to one or more of the first ends by contact with the body area, thereby creating a plurality of point pressures on the body area; and displacing the members axially along the channels away from the neutral position and toward the bottom surface without deformation so as to maintain the plurality of point pressures and alleviate excessive pressure from developing on the body area.

18. The method of claim 17, further comprising returning the members to the neutral position by removing contact of the body area with the one or more first ends.

19. The method of claim 17, wherein displacing the members axially is limited by compression of the inner layer and the bottom surface.

20. The method of claim 17, further comprising removably attaching the apparatus to another object or to a part of the body.

21. An apparatus for alleviating the excessive pressure development on a body area, the apparatus comprising:

a bottom surface;

a top surface spaced from the bottom surface, the top surface having a plurality of spaced apart channels formed therethrough;

a compressible intermediate layer disposed between the top and bottom surfaces; and a plurality of rigid members supported by the intermediate layer, each of the members movably received within a corresponding one of the plurality of channels and having a body contact end extending above the top surface, wherein when a pressure is applied to the body contact ends by the body area, the members are displaced axially along the channels away from a neutral position and compress the intermediate layer such that the members define multiple spaced apart pressure points on the body area, thereby maintaining areas of normal circulation between these pressure points to alleviate excessive pressure development on the body area, and wherein when the pressure is removed from the body contact ends, the members return to the neutral position.

* * * * *

UNITED STATES PATENT AND TRADEMARK OFFICE

CERTIFICATE OF CORRECTION

PATENT NO. : 6,241,695 B1
DATED : June 5, 2001
INVENTOR(S) : Reza R. Dabir

It is certified that error appears in the above-identified patent and that said Letters Patent is hereby corrected as shown below:

Column 5, claim 8,
Line 62, after "1/8" insert -- " -- (inch); and after "1/4" insert -- " -- (inch).

Signed and Sealed this

Thirteenth Day of November, 2001

*Attest:*

Nicholas P. Godici

NICHOLAS P. GODICI
*Acting Director of the United States Patent and Trademark Office*

*Attesting Officer*